US005856810A

United States Patent [19]

Lopez

[11] Patent Number: 5,856,810

[45] Date of Patent: Jan. 5, 1999

[54] LOW SIDELOBE MULTI-BEAM LOSSLESS FEED NETWORKS FOR ARRAY ANTENNAS

[75] Inventor: Alfred R. Lopez, Commack, N.Y.

[73] Assignee: GEC-Marconi Hazeltine Corp. Electronic Systems Division, Greenlawn, N.Y.

[21] Appl. No.: 725,105

[22] Filed: Oct. 2, 1996

[51] Int. Cl.[6] ..... H01Q 21/22

[52] U.S. Cl. ..... 343/853; 343/778; 342/373

[58] Field of Search ..... 343/853, 777, 343/778, 850, 700 MS; 342/372, 373, 354; H01Q 21/22

[56] References Cited

U.S. PATENT DOCUMENTS

| | | | |
|---|---|---|---|
| 3,255,450 | 6/1966 | Butler | 343/853 |
| 4,689,627 | 8/1987 | Lee et al. | 343/853 |
| 4,962,383 | 10/1990 | Tresselt | 343/853 |
| 5,125,108 | 6/1992 | Talwar | 343/853 |
| 5,281,974 | 1/1994 | Karamoto et al. | 343/853 |

*Primary Examiner*—Hoanganh T. Le
*Assistant Examiner*—Tho Phan
*Attorney, Agent, or Firm*—Edward A. Onders; Kenneth P. Robinson

[57] ABSTRACT

Multi-beam antenna feed networks employ more aperture ports (e.g., ports I, II, III, IV and V) than beam ports (e.g., ports A, B, C and D) to achieve low sidelobe lossless operation, particularly for cellular communications. With five aperture ports, signal value outputs at the aperture ports represent orthogonal outputs having phase gradients effective to provide a four beam radiation pattern. The feed arrangement includes directional couplers (e.g., C11, C21) and phase shifters (e.g., P22, P23) intercoupled between the beam ports and aperture ports to provide the desired orthogonal aperture excitation. An example of specific directional coupler and phase shifter circuit values for a matrix network for a four beam port to five aperture port feed network configuration is provided.

8 Claims, 3 Drawing Sheets

LOW SIDELOBE MULTI-BEAM LOSSLESS FEED NETWORKS FOR ARRAY ANTENNAS

This invention relates to multi-beam feed networks for array antennas and, more particularly, to such feed networks capable of achieving low sidelobe lossless operation by provision of orthogonal aperture excitations in response to beam port input signals.

BACKGROUND OF THE INVENTION

Use of multi-beam antennas is common in applications such as cellular communications, where benefits including increased range and improved signal reception may be achieved. For example, rather than providing coverage of a 120 degree azimuth sector at a cell site with an antenna providing a single 120 degree beam, sector coverage may be provided by a multi-beam antenna having a higher gain radiation pattern including four 30 degree beams.

It will be appreciated that efficiency and effectiveness of coverage by the multi-beam antenna will depend on factors such as signal loss or dissipation in a feed network used to provide the four beam pattern and sidelobe characteristics which may permit operation to be degraded in the presence of interference or noise effects.

Efforts have been made to design multi-beam feeds capable of providing lossless operation, well known Butler networks being one example. For present purposes, "lossless", in the context of a multi-beam feed network, is defined as a general absence of resistive elements at a pattern of locations in the feed network, although a small number (e.g., one resistive termination) of such elements may be present. Thus, lossless feed networks are not absolutely lossless, but are much less lossy than a feed network including resistive elements in a series of parallel paths or at many directional couplers in a coupling matrix, for example. Lossless feed configurations are discussed in Hansen, R. C., *Microwave Scanning Antennas*, Vol. III *Array Systems*, Academic Press, 1966, at pages 258–263.

Relevant constraints in achieving both required operating characteristics and lossless operation of multi-beam feed networks is discussed, for example, in a paper entitled "Optimum Low Sidelobe High Crossover Multiple Beam Antennas", by E. C. DuFort, appearing in *IEEE Transactions on Antennas and Propagation*, Vol. AP-33, No. 9, September 1985, at pages 946–954. This paper makes reference to prior development of certain specific forms of lossless array feeds and points out that beams must be mutually orthogonal in order to be derived from a lossless feed network. The paper states the conclusion that prior efforts toward development of similar types of lossless networks, with higher beam crossover points and lower sidelobes, was generally not successful in providing feeds suitable for applications of interest.

Thus, while the advantages of low sidelobe lossless feed networks have been recognized, practical feed networks of this type suitable for particular applications have not been available in the prior art. In this context, it is relevant to observe that for many current cellular applications achievement of high crossover radiation beam characteristics is somewhat less critical than in other applications. Lossless operation and low sidelobe characteristics are important in cellular applications.

It is, therefore, an objective of the present invention to provide new and improved lossless feed networks suitable for cellular and other applications. More particularly, objects of the invention are to provide feed networks having one or more of the following characteristics and capabilities:

lossless (minimized resistive loss) operation;

low sidelobe radiation pattern;

multi-beam operation with orthogonal excitation outputs;

aperture ports fed by a smaller number of beam ports;

a larger number of aperture ports than radiated beams;

economical, reliable design; and improved cellular performance.

SUMMARY OF THE INVENTION

In accordance with the invention, a multi-beam antenna feed network with more aperture ports than beam ports is configured to enable low sidelobe lossless operation. The feed network includes five aperture ports, referenced as ports I, II, III, IV and V, four beam ports, referenced as ports A, B, C and D, and an intercoupling feed arrangement. The feed arrangement comprises directional coupler elements and phase shift elements intercoupled between the beam ports and the aperture ports. The feed arrangement is responsive to beam port signal inputs to provide relative signal value outputs at the aperture ports as follows:

beam port A input, aperture port outputs: I=0.7; II=1; III=1; IV=1; V=0.7;

beam port B input, aperture port outputs: I=0.7; II=−1; III=1; IV=−1; V=0.7;

beam port C input, aperture port outputs: I=0.7; II=j; III=−1; IV=−j; V=0.7;

beam port D input, aperture port outputs: I=0.7;, II=−j; III=−1; IV=j; V=0.7.

As thus proportioned and phased, the signal value outputs at the aperture ports represent orthogonal excitations having phase gradients effective to provide a four beam radiation pattern.

For a better understanding of the invention, together with other and further objects, reference is made to the accompanying drawings and the scope of the invention will be pointed out in the accompanying claims.

DESCRIPTION OF THE INVENTION

The use of beam forming networks is well known. A four channel Butler network may typically have four input beam ports coupled to four radiating elements, so that an input signal at any one of the beam ports results in an excitation of each of the radiating elements to produce one radiation pattern beam. The Butler network produces a differently phased and proportioned aperture output excitation for each beam port, resulting in four differently aimed beams for the four beam ports in this example. Such arrangements provide reciprocal operation for transmission and reception and, even though a cellular system may be used solely for reception in some applications, system operation may conveniently be described in terms of the signal relationships pertinent to transmission.

Figure 1:
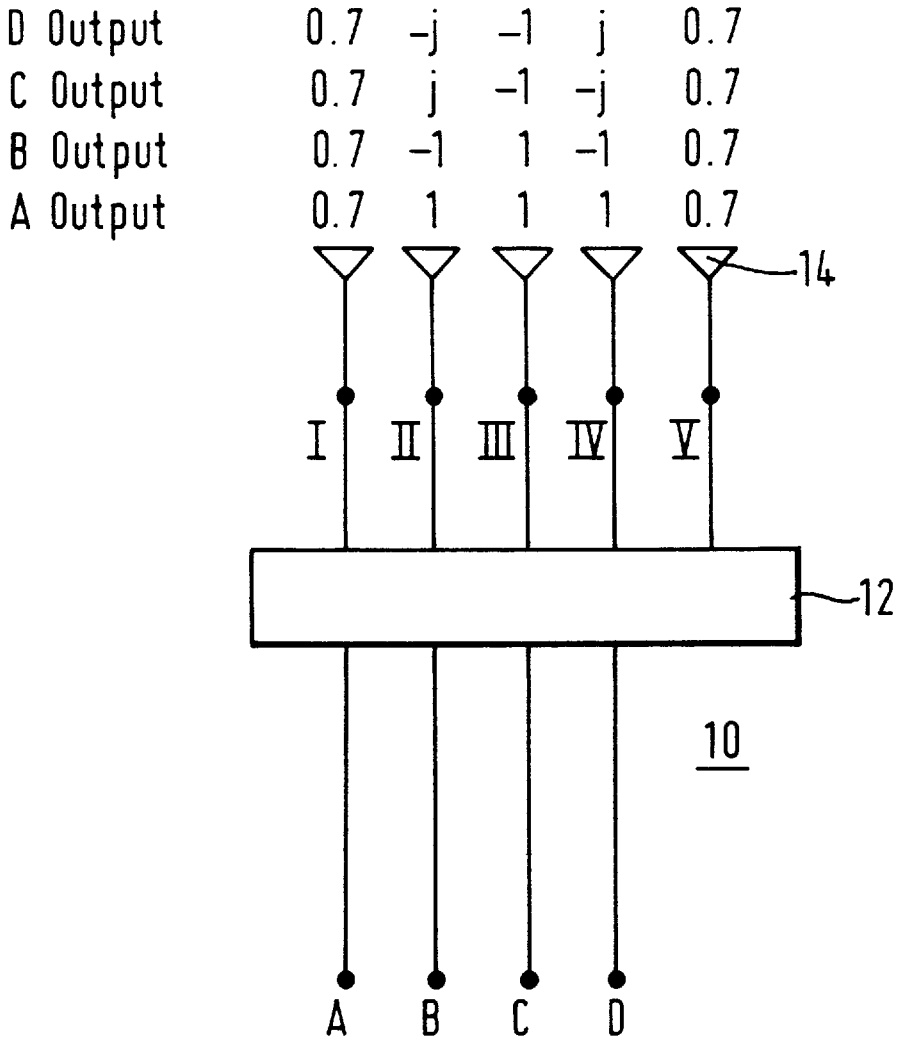
FIG. 1 is a block diagram of an antenna system including a feed network in accordance with the invention.

FIG. 1 is a block diagram of an antenna system utilizing a multi-beam antenna feed network in accordance with the present invention, in order to achieve low sidelobe lossless operation, via a four beam radiation pattern. For purposes of initial comparison, based on computed performance of a 4×4 Butler configuration, as discussed, provides lossless operation with sidelobes 12 dB down, while the 4×5 feed network of FIG. 1 provides lossless operation with sidelobes 15 dB down and certain other performance advantages to be discussed.

In the FIG. 1 antenna system, the feed network 10 includes:

five aperture ports, referenced as ports I, II, III, IV and V;

four beam ports, referenced as ports A, B, C and D, for input of signals to be transmitted and output of signals received via respective ones of the four beams; and a feed arrangement 12 intercoupling the aperture ports and beam ports.

The FIG. 1 configuration also includes five radiating elements of any suitable type, typically referenced at 14.

For a currently preferred exemplary embodiment, there are also indicated in FIG. 1 relative signal value outputs at the aperture ports I–V (and thereby at respective ones of radiating elements 14) responsive to signal inputs at beam ports A–D. Thus, as shown, feed arrangement 12 is responsive to beam port input signals to provide relative signal value outputs at the aperture ports as follows:

beam port A input, aperture port outputs: I=0.7; II=1; III=1; IV=1; V=0.7;

beam port B input, aperture port outputs: I=0.7; II=−1; III=1; IV=−1; V=0.7;

beam port C input, aperture port outputs: I=0.7; II=j; III=−1; IV=−j; V=0.7;

beam port D input, aperture port outputs: I=0.7; II=−j; III=−1; IV=j; V=0.7.

These signal value outputs at aperture ports I–V represent orthogonal outputs having phase gradients effective to provide a four beam radiation pattern.

Figure 2:
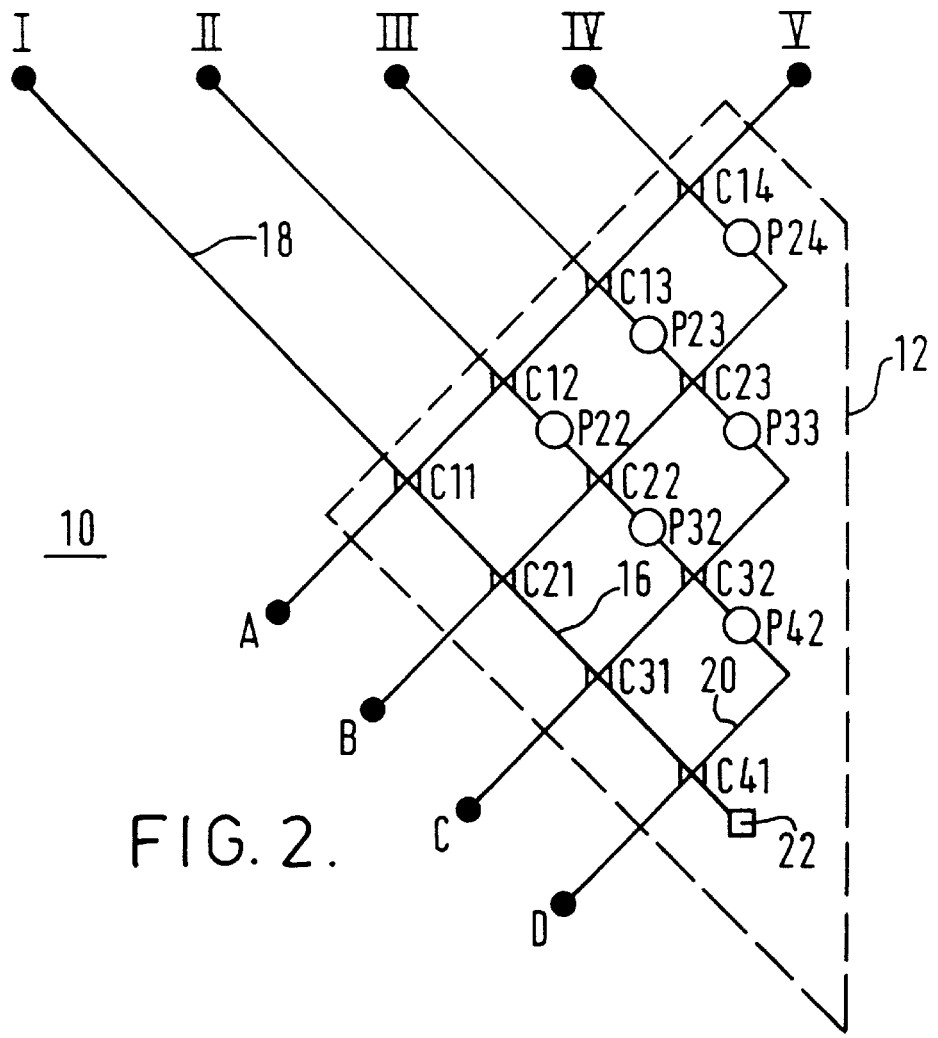
FIG. 2 is a circuit diagram of an embodiment of the FIG. 1 feed network.

Referring now to FIG. 2, there is illustrated a circuit is diagram of an embodiment of the FIG. 1 feed network 10. As shown, feed arrangement 12 comprises directional coupler elements C11, C12, C13, C14, C21, C22, C23, C31, C32 and C41 and phase shift elements P22, P23, P24, P32, P33 and P41 intercoupled between the beam ports A–D and aperture ports I–V by transmission line sections. A typical line section intercoupling directional couplers is indicated at 16 and a typical line section coupling a directional coupler to an aperture port is indicated at 18. Other line sections, such as 20, couple directional couplers to phase shift elements.

Figure 3:
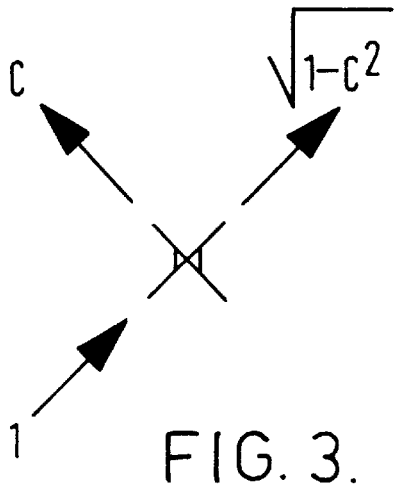
FIG. 3 and FIG. 4 are diagrams useful in describing operating characteristics of directional couplers of the FIG. 2 feed network.
Figure 4:
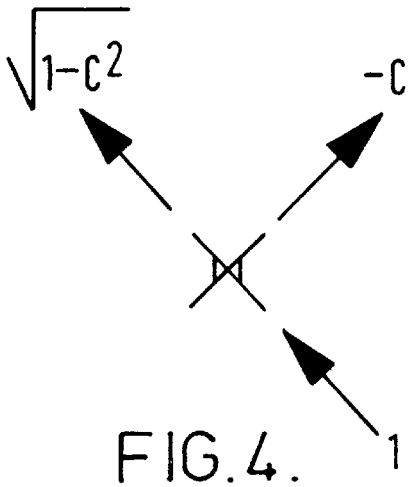

FIGS. 3 and 4 identify the convention used for directional coupler circuit values. Thus, in FIG. 3, a unitary signal input at a lower left arm of a directional coupler results in a straight-through output signal value equal to the square root of the quantity $1-C^2$ and also an output signal value at the normal arm equal to C. As indicated in FIG. 4, a unitary signal input at a lower right arm of a directional coupler results in a straight-through output signal value equal to the square root of the quantity $1-C^2$ and also an output signal value at the normal arm equal to −C. For purposes of the current 4×5 example (five output signals for each of four input signals) the respective values for C of the directional couplers of FIG. 2 are as follows:

C11=0.35355; C12=0.53452; C13=0.63246; C14=0.81650; C21=0.37796; C22=0.54772; C23=0.66667; C31=0.40825; C32=0.7746; and C41=0.44721.

Also, for this embodiment the respective values for P (in degrees) of the phases shift elements of FIG. 2 are as follows:

P22=180; P23=0; P24=180; P32=−90; P33=180; and P42=180.

In this embodiment all phase and coupling values are fixed, except for possible adjustment to optimize performance in a physical implementation of the feed network, component aging, etc. Transmission line sections (e.g., 16, 18 and 20) have a characteristic impedance of 50 ohms and one 50 ohm resistive termination is included in the feed network, at 22 in FIG. 2.

Figure 5:
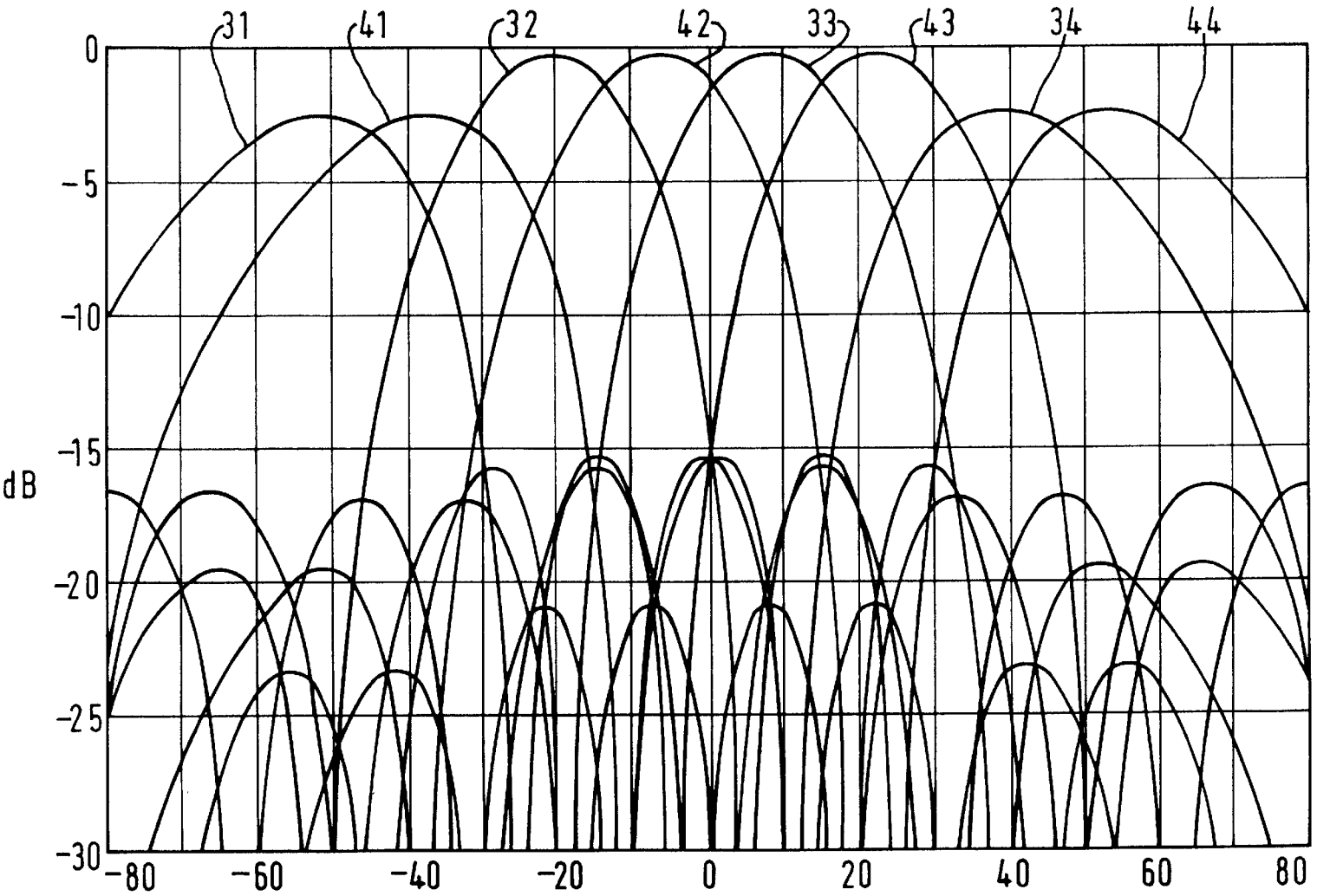
FIG. 5 is a computed radiation pattern for the FIG. 2 feed network.

The computed radiation pattern for two multi-beam array antennas, each using a FIG. 2 feed network, is provided in FIG. 5. Thus, beams 31, 32, 33 and 34 represent the first array antenna and beams 41, 42, 43 and 44 of the second array antenna (which is rotated slightly to radiate with a 15 degree angular offset) are superimposed. As shown, beam sets 31–33 and 41–43 each provide four 30 degree beams (width at −3 dB points) for coverage of a sector 120 degrees wide, with beam crossover at −5.24 dB (relative to peak). This performance is provided on a lossless basis with sidelobes more than 15 dB down. While not directly pertinent to this description, the use of two similar array antennas with angular offset enables cellular operation with both space diversity and angle diversity for improved area coverage and reliability of coverage.

Computed performance factors for cellular communications applications, on a comparative basis between the FIG. 2 four by five feed network and a Butler four by four network configured to provide a closely similar four beam radiation pattern, are as follows:

| | 4 × 4 Butler | FIG. 2 |
|---|---|---|
| Sidelobes | −12 dB | −15 dB |
| Horizontal Pattern | | |
| (1) directivity (dB) | 6.0 | 7.0 |
| (2) aperture efficiency (dB) | 0.0 | −0.1 |
| (3) feed network loss (dB) | −0.6 | −0.6 |
| (4) peak gain (dB) | 5.4 | 6.3 |
| (5) crossover level (dB) | 1.7 | 1.1 |
| (6) average gain (dB) | 4.2 | 4.6 |
| (7) range extension factor | 1.27 | 1.30 |
| (8) coverage area increase (%) | 62 | 70 |
| Interference Reduction | | |
| (9) Maximum (dB) | 6.0 | 6.9 |
| (10) Average (dB) | 4.8 | 5.2 |
| (11) Minimum (dB) | 2.3 | 1.7 |

For purposes of the foregoing:

Item (4) is the sum of items (10, (2) and (3).

Item (6) is determined as item (4) minus one-third of the quantity item (4) less item (5).

Item (7) uses a 1 over R to the fourth, distance loss factor.

Item (8) represents the value of item (7) squared, less 1, as a percentage.

Items (9)–(11) are based on integration of antenna patterns, assuming interference uniform over angle.

With an understanding of the invention, skilled persons will be enabled to implement feed networks in accordance with the invention for cellular and other applications. Any suitable types and constructions of traditional or other forms of directional couplers, or other directional coupler elements, and phase shifters, or other phase shift elements, may be employed in modular or integrated form with appropriate transmission line elements. While a four by five feed network has been particularly described, the more aperture ports than beam ports design constraint pursuant to the invention can also be applied in feed networks with other than five aperture ports and four beam ports.

While there have been described the currently preferred embodiments of the invention, those skilled in the art will recognize that other and further modifications may be made without departing from the invention and it is intended to claim all modifications and variations as fall within the scope of the invention.

What is claimed is:

1. A multi-beam antenna feed network with more aperture ports than beam ports, to enable low sidelobe lossless operation, comprising:

five aperture ports, referenced as ports I, II, III, IV and V;

four beam ports, referenced as ports A, B, C and D; and a feed arrangement comprising directional coupler elements and phase shift elements intercoupled between said beam ports and said aperture ports and responsive to beam port signal inputs to provide relative signal value outputs at said aperture ports as follows:

beam port A input, aperture port outputs: I=0.7; II=1; III=1; IV=1; V=0.7;

beam port B input, aperture port outputs: I=0.7; II=−1; III=1; IV=−1; V=0.7;

beam port C input, aperture port outputs: I=0.7; II=j; III=−1; IV=−j; V=0.7;

beam port D input, aperture port outputs: I=0.7;, II=−j; III=−1; IV=j; V=0.7;

said signal value outputs at the aperture ports representing orthogonal excitations having phase gradients effective to provide a four beam radiation pattern.

2. A feed network as in claim 1, wherein each of said directional coupler elements is a four terminal directional coupler and said lossless operation is achieved by resistively terminating only one terminal of only one of said directional couplers.

3. A feed network as in claim 1, additionally comprising five radiating elements, one coupled to each of said aperture ports, to provide said four beam radiation pattern.

4. A feed network as in claim 1, wherein said directional coupler elements and phase shift elements are intercoupled by transmission line sections, said aperture ports and beam ports comprising end portions of selected ones of said transmission line sections.

5. A multi-beam feed network with more aperture ports than beam ports, to enable low sidelobe lossless operation, comprising:

five aperture ports, each for coupling to a radiating element;

a plurality of directional couplers;

a first beam port coupled in series to a first rank of four of said directional couplers none of which is resistively terminated, and coupled via directional couplers of said first rank to each of said five aperture ports;

a second beam port coupled in series to a second rank of three of said directional couplers none of which is resistively terminated, and coupled via directional couplers of said second rank to said first rank of directional couplers;

a third beam port coupled in series to a third rank of two of said directional couplers none of which is resistively terminated, and coupled via directional couplers of said third rank to said second rank of directional couplers;

a fourth beam port coupled to a fourth rank of a single one of said directional couplers which is resistively terminated, and coupled via the directional coupler of said fourth rank to said third rank of directional couplers; and a plurality of phase shift elements positioned in selected signal paths coupled to said ranks of directional couplers, said phase shift elements configured to provide predetermined phase shifts.

6. A feed network as in claim 5, additionally comprising five radiating elements, one coupled to each of said aperture ports, to provide said four beam radiation pattern.

7. A feed network as in claim 5, wherein said directional coupler elements and phase shift elements are intercoupled by transmission line sections, said aperture ports and beam ports comprising end portions of selected ones of said transmission line sections.

8. A feed network as in claim 5, wherein said five aperture ports (referenced as ports I, II, III, IV and V)) and said four beam ports (referenced as ports A, B, C and D) are intercoupled by said directional couplers and said phase shift elements to provide, in response to beam port signal inputs, relative signal value outputs at said aperture ports as follows:

beam port A input, aperture port outputs: I=0.7; II=1; III=1; IV=1; V=0.7;

beam port B input, aperture port outputs: I=0.7; II=−1; III=1; IV=−1; V=0.7;

beam port C input, aperture port outputs: I=0.7; II=j; III=−1; IV=−j; V=0.7;

beam port D input, aperture port outputs: I=0.7;, II=−j; III=−1; IV=j; V=0.7;

said signal value outputs at the aperture ports representing orthogonal excitations having phase gradients effective to provide a four beam radiation pattern.

* * * * *